US011220017B2

(12) United States Patent
Azmi et al.

(10) Patent No.: US 11,220,017 B2
(45) Date of Patent: Jan. 11, 2022

(54) CUTTING DEVICE

(71) Applicant: The Green Twist LLC, Tenafly, NJ (US)

(72) Inventors: Hooman Azmi, Tenafly, NJ (US); Arman Azmi, Tenafly, NJ (US); Mazyar Azmi, Tenafly, NJ (US)

(73) Assignee: THE GREEN TWIST LLC, Tenafly, NJ (US)

( * ) Notice: Subject to any disclaimer, the term of this patent is extended or adjusted under 35 U.S.C. 154(b) by 0 days.

(21) Appl. No.: 16/529,324

(22) Filed: Aug. 1, 2019

(65) Prior Publication Data

US 2020/0038977 A1 Feb. 6, 2020

Related U.S. Application Data

(60) Provisional application No. 62/713,240, filed on Aug. 1, 2018.

(51) Int. Cl.
*B26B 27/00* (2006.01)

(52) U.S. Cl.
CPC ..... *B26B 27/005* (2013.01)

(58) Field of Classification Search
CPC ..... B26B 27/005; B26B 5/00; B26B 5/005; B26B 5/006; B26B 5/008; A21C 11/106; A21C 9/068; B65B 69/0033; B65B 69/0041; B65D 5/746–749
USPC .... 30/1.5, 2, 113.1, 114–117, 299, 301, 302, 30/358, 366
See application file for complete search history.

(56) References Cited

U.S. PATENT DOCUMENTS 107,061 A * 9/1870 Kaufman ..... B67B 7/30 30/445
158,420 A * 1/1875 Knapp ..... A47J 25/00 30/113.1
580,916 A * 4/1897 Westerfield ..... B67B 7/24 30/446
602,654 A * 4/1898 Cameron, Jr. ..... 30/411
893,043 A * 7/1908 Westerberg ..... B65D 5/42 30/2
1,024,403 A * 4/1912 Hill ..... B67B 7/12 81/3.48
1,031,243 A * 7/1912 Carnes ..... A21C 11/106 30/301
1,102,124 A * 6/1914 Baptiste ..... B67B 7/30 30/1.5
1,293,351 A * 2/1919 Creasey ..... A47J 25/00 30/113.1
1,744,422 A * 1/1930 Taylor ..... A47J 25/00 30/302

(Continued)

FOREIGN PATENT DOCUMENTS

CN 101716587 A 6/2010
DE 2 815 383 A1 10/1979

(Continued)

*Primary Examiner* — Jason Daniel Prone
(74) *Attorney, Agent, or Firm* — Myers Wolin, LLC

(57) ABSTRACT

A cutting device, including: a handle rotatable about a central axis; and at least one blade attached to the handle, a cutting edge of the at least one blade is at a first distance from the central axis; wherein the handle comprises an opening around the central axis configured to accommodate a protruded part on a surface to be cut. A method of using the cutting device is also disclosed.

12 Claims, 8 Drawing Sheets

Cap off and blades out

(56) References Cited

U.S. PATENT DOCUMENTS 2,028,175 A * 1/1936 Waite ..... B65D 47/38 222/83
2,227,421 A * 1/1941 Bjork ..... B67B 7/30 30/1.5
2,249,631 A * 7/1941 Kershenstein ..... B67B 7/24 30/286
2,332,595 A * 10/1943 Paquette ..... A21C 11/106 30/301
2,566,653 A * 9/1951 Callahan et al. ..... B67B 7/30 30/1.5
2,663,460 A * 12/1953 Keeney ..... B67B 7/28 222/86
2,759,544 A 8/1956 De Vries
2,990,615 A * 7/1961 Ohler ..... A47J 25/00 30/113.1
3,292,257 A * 12/1966 Popeil ..... A47J 17/02 30/301
3,574,050 A 4/1971 Rice
3,581,605 A * 6/1971 Taylor ..... B67B 7/24 30/1.5
3,726,545 A * 4/1973 Grim ..... F16L 41/08 30/301
3,768,698 A * 10/1973 Corty, Sr. ..... B67B 7/26 222/91
3,922,099 A * 11/1975 Christine ..... A61M 3/00 401/134
3,944,127 A 3/1976 Bruke et al.
4,074,426 A * 2/1978 Brandt ..... B67B 7/30 30/1.5
4,182,151 A * 1/1980 Pedersen ..... B44D 3/12 30/446
4,209,903 A * 7/1980 Owens ..... A01G 3/06 30/302
4,277,891 A * 7/1981 Dick ..... B26B 27/00 30/316
4,572,444 A * 2/1986 Shadduck ..... B26B 5/008 30/301
4,596,073 A * 6/1986 Ewald ..... A47J 25/00 30/113.1
4,690,047 A * 9/1987 Balzano ..... A47J 25/00 30/302
4,723,689 A * 2/1988 Vallos ..... B67B 7/28 30/2
4,979,419 A * 12/1990 Sonkin ..... A21C 15/04 30/113.1
5,056,223 A * 10/1991 Buck ..... A47J 25/00 30/113.1
5,123,565 A * 6/1992 Majewski ..... B44D 3/128 220/287
5,330,076 A * 7/1994 Tsuruta ..... B65D 75/5877 222/83
5,366,114 A * 11/1994 Bernstein ..... B65D 5/748 222/83
5,482,176 A * 1/1996 Maietta ..... B65D 77/067 220/277
5,564,622 A * 10/1996 Wald ..... B65D 5/746 229/125.04
5,740,612 A * 4/1998 Takeshita ..... B26B 27/00 30/1.5
5,871,161 A 2/1999 Nishibori
5,878,497 A * 3/1999 Seemann, III ..... B67B 7/0441 30/1.5
6,032,368 A * 3/2000 Huang ..... A47J 25/00 30/113.1
6,058,610 A * 5/2000 Leang ..... B26B 3/00 30/301
6,237,227 B1 * 5/2001 Pojunas, Sr. ..... B26F 1/32 30/366
6,238,516 B1 5/2001 Watson et al.
6,279,779 B1 * 8/2001 Laciacera ..... B65D 5/748 222/541.2
6,364,164 B1 * 4/2002 Troiano ..... B65D 5/748 222/83
6,681,491 B2 1/2004 Currie
6,722,042 B1 * 4/2004 Naville, Jr. ..... B26B 5/00 30/280
6,820,764 B2 * 11/2004 Miani ..... B65D 5/748 222/83
7,159,320 B2 * 1/2007 Moore ..... B26B 27/00 30/113.1
7,207,465 B2 * 4/2007 Weist ..... B65D 5/748 222/83
7,458,486 B2 * 12/2008 Weist ..... B65D 5/748 222/83
7,878,353 B2 * 2/2011 Casale ..... B65D 5/749 215/297
8,714,380 B2 * 5/2014 Casale ..... B65D 5/747 215/297
D734,108 S * 7/2015 Madden ..... D7/675
9,623,996 B2 * 4/2017 Casale ..... B65D 5/747
10,676,261 B2 * 6/2020 Berge ..... B65D 5/748
2002/0092169 A1 * 7/2002 Kilduff ..... B67B 7/30 30/1.5
2004/0093738 A1 * 5/2004 Mauro ..... B26D 5/10 30/113.1
2005/0102838 A1 * 5/2005 Leason ..... B26B 5/00 30/134
2005/0229405 A1 * 10/2005 Endres ..... B26B 5/008 30/305
2015/0258675 A1 * 9/2015 Laybourne ..... B26B 27/007 30/298

FOREIGN PATENT DOCUMENTS

EP 3 769 355 A1 4/1997
FR 2 729 883 A1 8/1996
JP 3039962 U 8/1997

* cited by examiner

Cap off and blades out

Cap off with blades still screwed onto cap

CUTTING DEVICE

CROSS REFERENCE TO RELATED APPLICATIONS

This application claims the benefit of U.S. Provisional Application No. 62/713,240, filed Aug. 1, 2018, the contents of which are incorporated by reference herein.

FIELD OF THE INVENTION

This invention relates generally to cutting equipment, and more particularly to a cutting device for removing the plastic spout on milk and juice cartons.

BACKGROUND

Liquids, such as milk and juice, are sold in cartons made from cardboard or paper-like material, laminated with a plastic or a metal foil layer to make the cartons liquid-proof. To make it easy for dispensing the liquid, a spout is usually put on the carton.

In recent years, environmental concerns have prompted consumers to recycle a lot of containers, including milk and juice cartons. However, the spouts on the cartons are mostly made of some plastic materials that are different from the paper materials that make up the rest of the carton body. Thus, recycling this type of cartons would require an additional step of removing the spouts from the cartons for separate material recycling lines.

Cutting devices, such as box-cutters, knives, scissors, etc., may be used to remove the spout on a liquid carton. However, using such devices is cumbersome and dangerous, because of the fact that the geometry of the carton and the placement of the spout on the carton make the maneuvering of the cutter around the spout very awkward. Therefore, there is a need for a cutting device for removing the spouts from the liquid cartons easily and safely.

SUMMARY

An embodiment of the present invention provides a cutting device, including: a handle rotatable about a central axis; and at least one blade attached to the handle, a cutting edge of the at least one blade is at a first distance from the central axis; wherein the handle comprises an opening around the central axis configured to accommodate a protruded part on a surface to be cut.

Another embodiment of the present invention provides a cutting method by using a cutting device, wherein the cutting device includes: a handle rotatable about a central axis, and at least one blade attached to the handle, a cutting edge of the at least one blade is at a first distance from the central axis, and wherein the handle includes an opening around the central axis configured to accommodate a protruded part on a surface to be cut, the method including: aligning the opening of the handle with the protruded part on the surface to be cut; allowing the protruded part to go through the opening and the cutting edge to make contact with the surface; and turning the handle about the central axis so as to cause the blade rotationally cutting the surface.

DETAILED DESCRIPTION OF THE PREFERRED EMBODIMENTS

Figure 1:
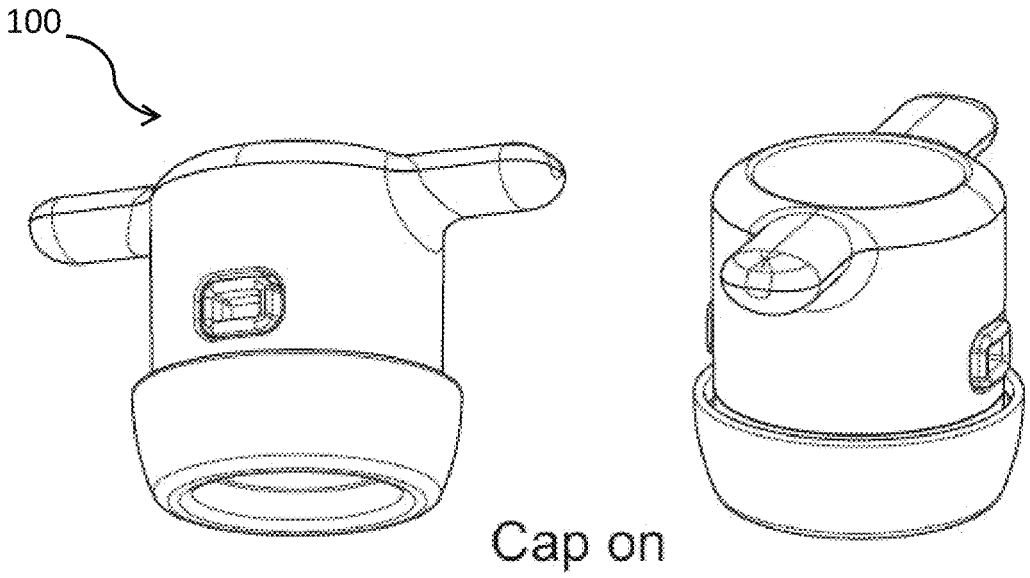
FIG. 1 shows two different perspective views of a cutter device with the cap on according to an embodiment.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
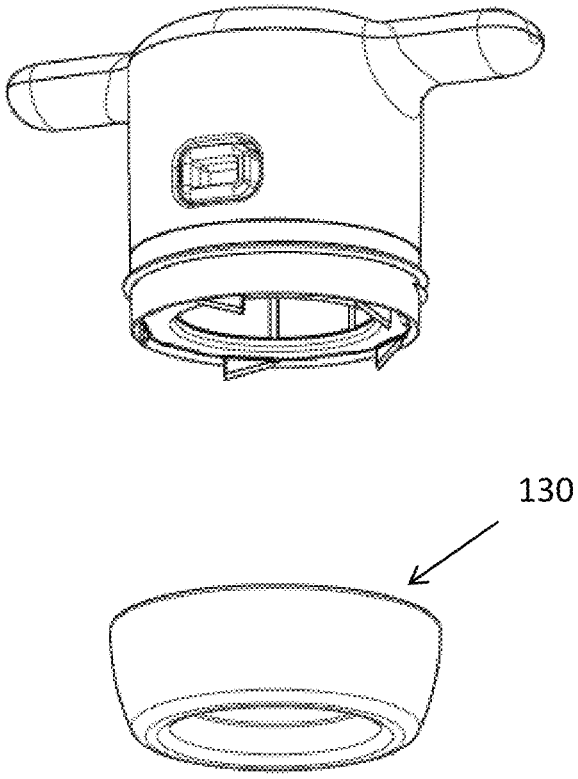
FIG. 2 shows a perspective view of a cutter device with the cap off according to an embodiment.
Figure 3:
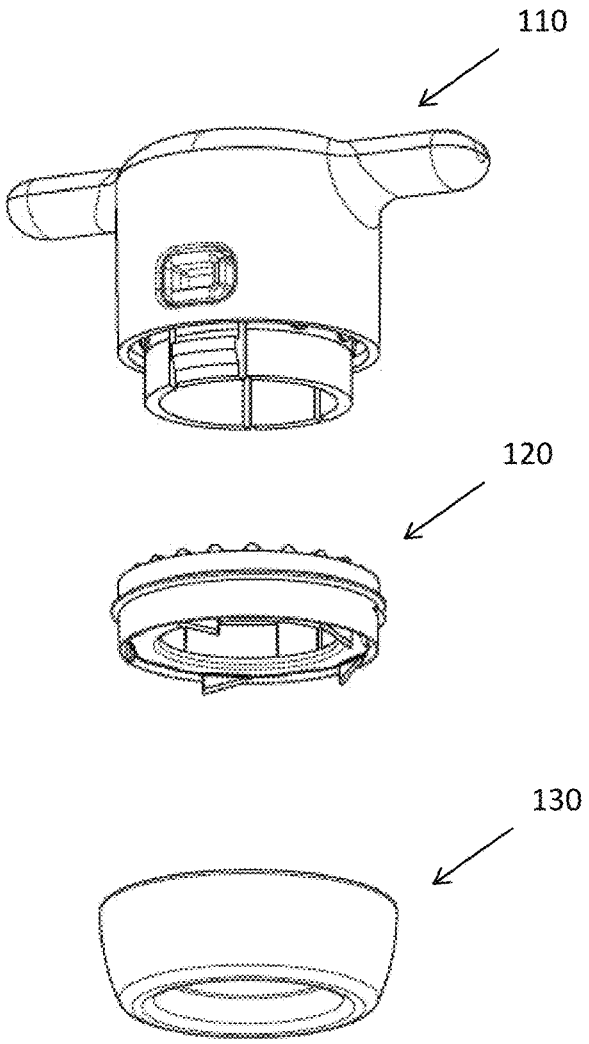
FIG. 3 shows a perspective view of a cutter device with the cap off and the blades out according to an embodiment.
Figure 4:
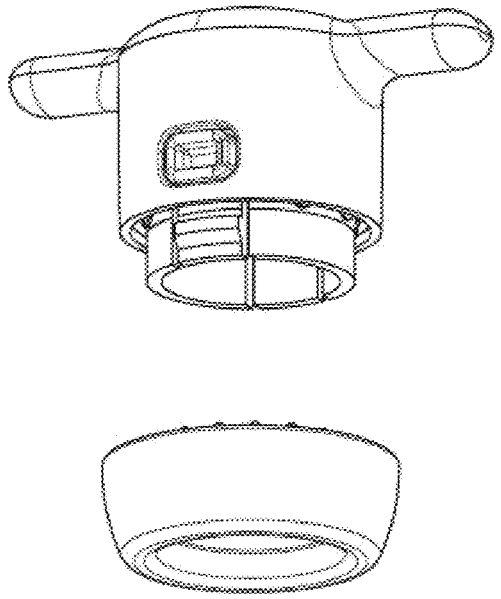
FIG. 4 shows a perspective view of a cutter device with the cap off with the blades screwed onto the cap according to an embodiment.

FIG. 1 shows a cutter 100 according to an embodiment of the present invention. In this embodiment, there is an optional cap 130 that covers the blades for safety when the cutter is not in used or in storage. FIG. 2 shows that the blades are exposed when the cap is taken off. In one embodiment, the blade cartridge 120 can be removed from the handle 110 as shown in FIG. 3. In one embodiment, the blade cartridge is screwed onto the cap as shown in FIG. 4. Other means of securing the blade cartridge onto the cap are also contemplated.

Figure 5:
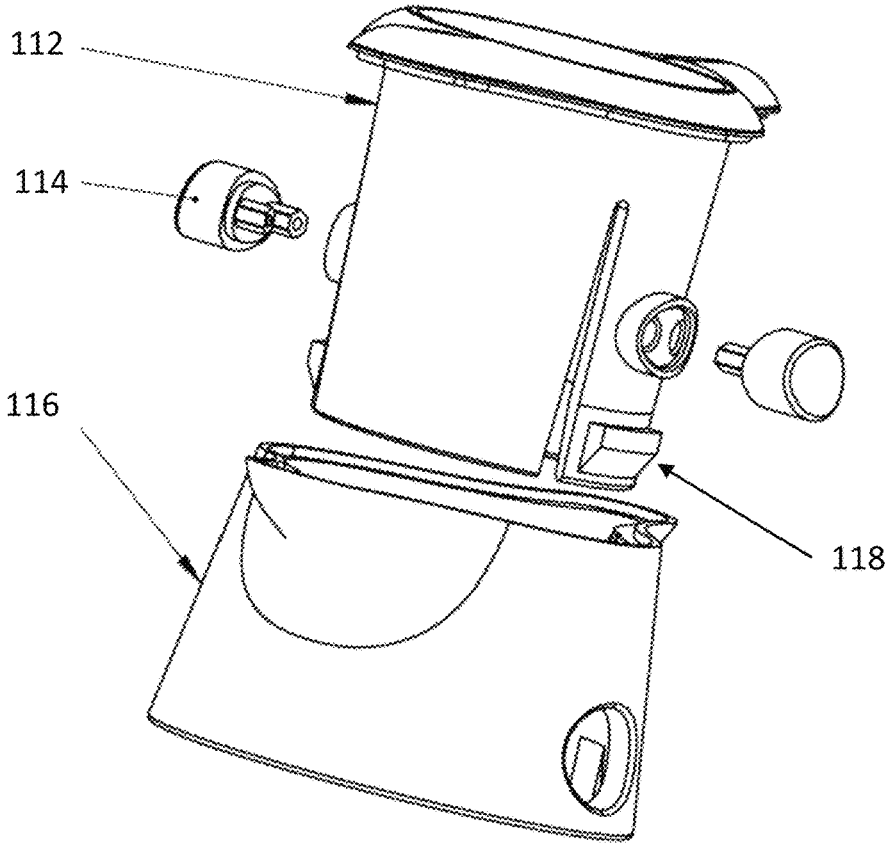
FIG. 5 shows an exploded view of a handle of a cutter device according to an embodiment.

FIG. 5 is an exploded view of the cutter handle according to an embodiment. The handle includes a core 112, one or more buttons 114 and a housing 116. The core 112 fits into the housing 116 which has one or more holes to allow the one or more buttons 114 to project out of the housing. A blade cartridge is configured to be fixed to the handle via a fixing means, such as a snap-fit joint, a screw-thread joint, etc. In one embodiment, the core 112 includes one or more cantilever arms with a hook 118 configured as snap-fit joints to catch a mating part in a blade cartridge. To fix the blade cartridge to the handle, the handle is pushed into the blade cartridge with the cap. When the cap is removed, the cutter is ready for use. The blade cartridge may be removed for replacement. When the buttons 114 are pressed, the cantilever arms are bent inwards, releasing the snap-fit joints, and the blade cartridge is detached from the handle.

Figure 6:
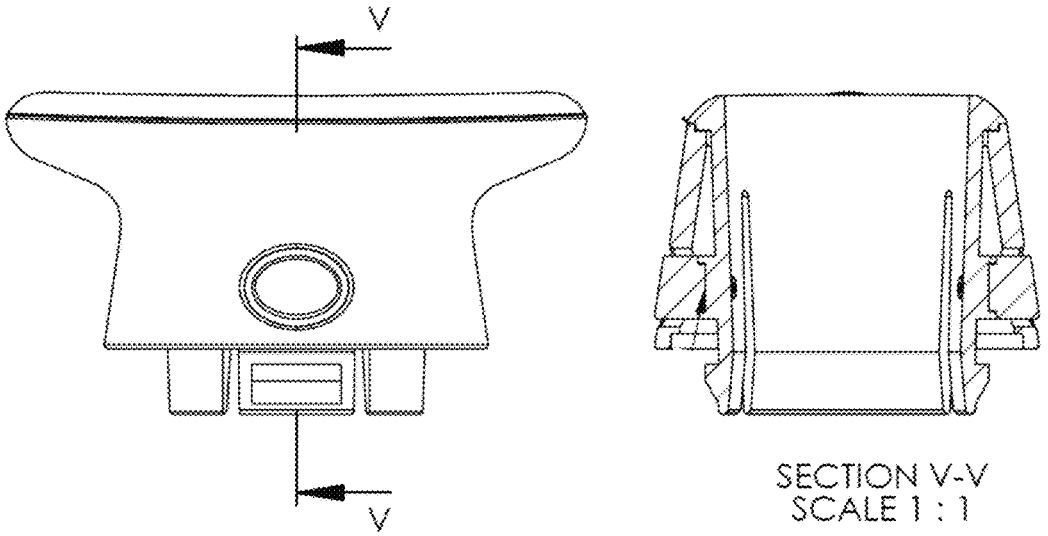
FIG. 6 shows the front view and cross-sectional view of a handle of a cutter device according to an embodiment.

FIG. 6 shows the front view and cross-sectional view of the handle according to an embodiment. As can be seen from the figure, the core of the handle has a hollow center which would accommodate a protruding part on a surface to be cut, e.g., spout on a milk carton, such that when the cutter is place on top of the protruding part, the blade edges may make contact with the surface to be cut.

Figure 7:
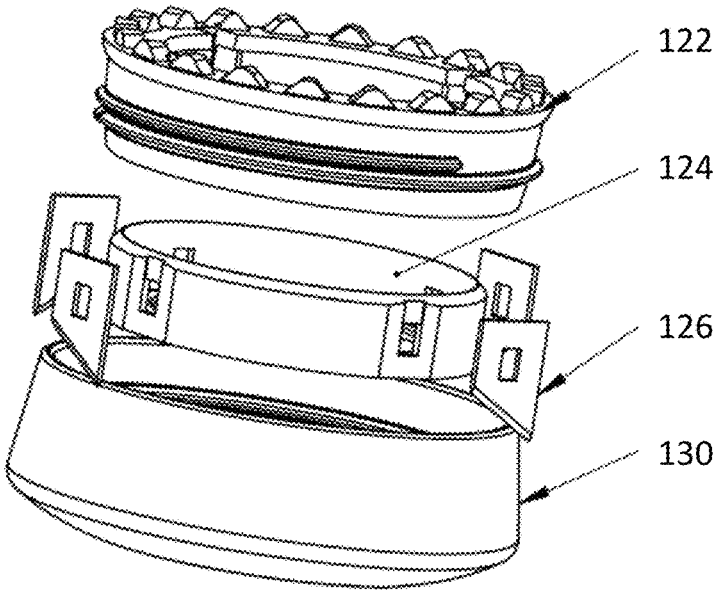
FIG. 7 shows an exploded view of a cutter blade cartridge according to an embodiment.

FIG. 7 is an exploded view of the blade cartridge according to an embodiment. The blade cartridge includes a blade outer housing 122. In one embodiment, the blade outer housing is threaded so as to screw onto the cap 130 having a matching threading. In one embodiment, the blade outer housing has teeth that match the corresponding teeth in the handle so as to transfer rotational force from the handle to the blades. FIG. 7 also shows that the blade inner housing 124 has slots to accommodate one or more blades 126. In one embodiment, the blade 126 is made of stainless steel.

Figure 8:
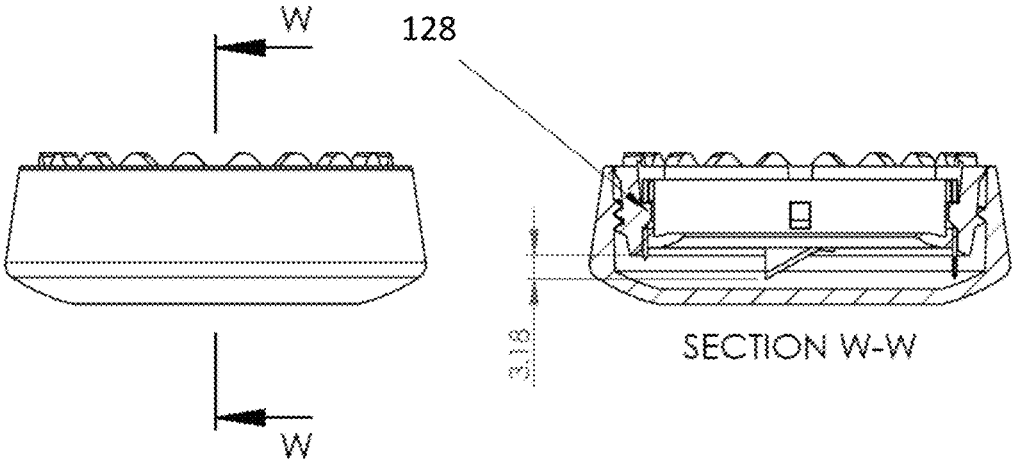
FIG. 8 shows the front view and cross-sectional view of a cutter blade cartridge with a cap according to an embodiment.
Figure 9:
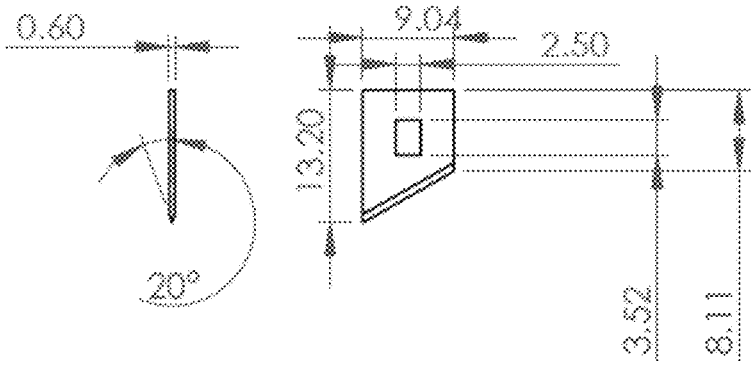
FIG. 9 shows the front view and side view of a cutter blade according to an embodiment.

FIG. 8 shows the front view and cross-sectional view of the blade cartridge in the cap according to an embodiment. As can be seen from FIG. 8, the blade outer housing 122 has one or more hooks 128 configured as snap-fit joints to catch the holes on the blade 126 and on the blade inner housing 124. The snap-fit joints hold the blade outer housing 122, blade inner housing 124 and one or more blades 126 together to form the cutter blade cartridge. FIG. 9 shows the front and side views of the blade 126 with example dimensions according to an embodiment.

Figure 10:
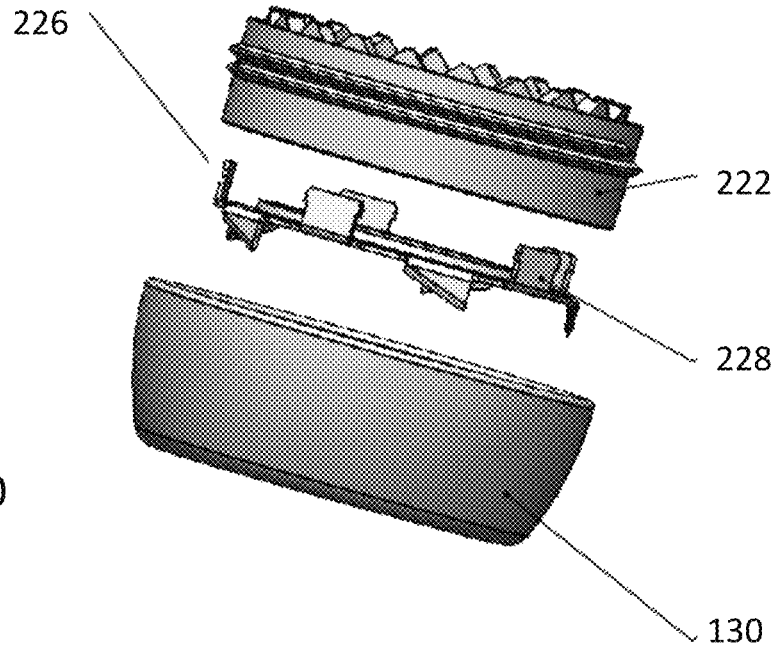
FIG. 10 shows an exploded view of a cutter blade cartridge according to an embodiment.
Figure 11:
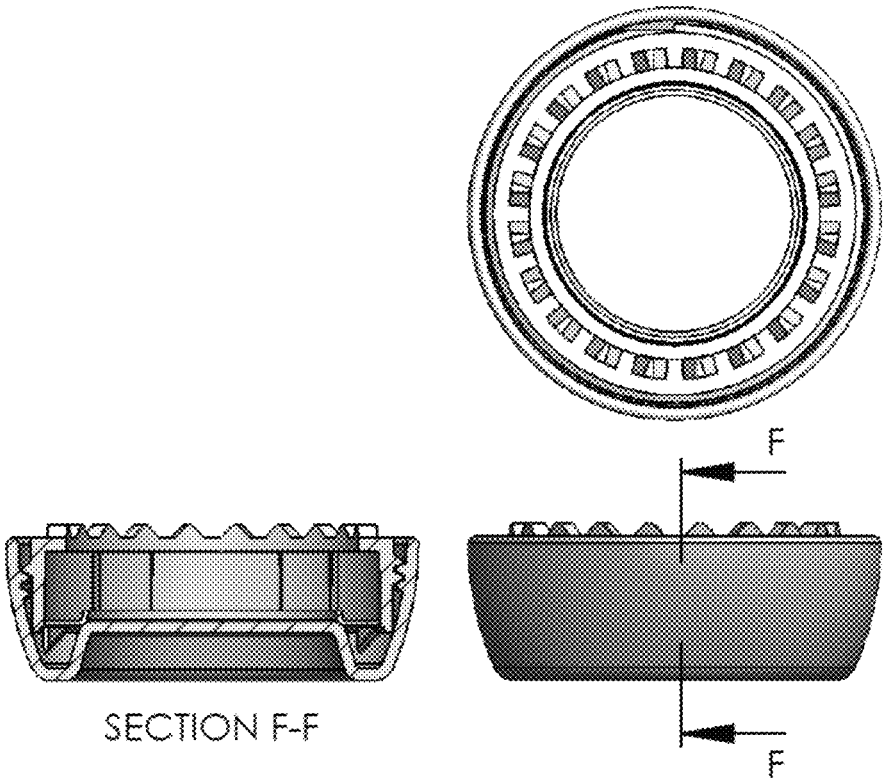
FIG. 11 shows the top view, front view and cross-sectional view of a cutter blade cartridge with a cap according to an embodiment.
Figure 12:
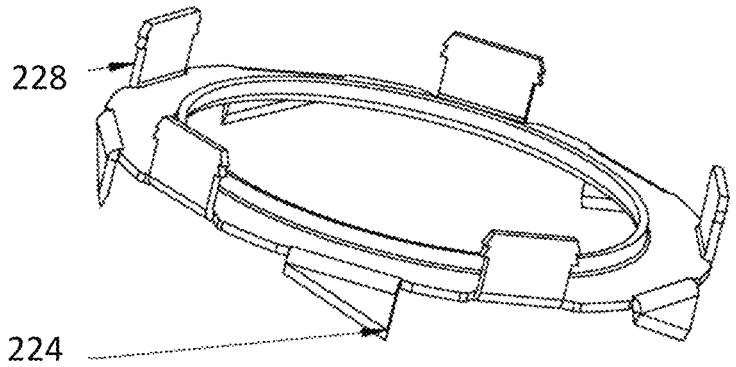
FIG. 12(A), FIG. 12(B), and FIG. 12(C) show different views of a cutter blade according to an embodiment.
Figure 12:
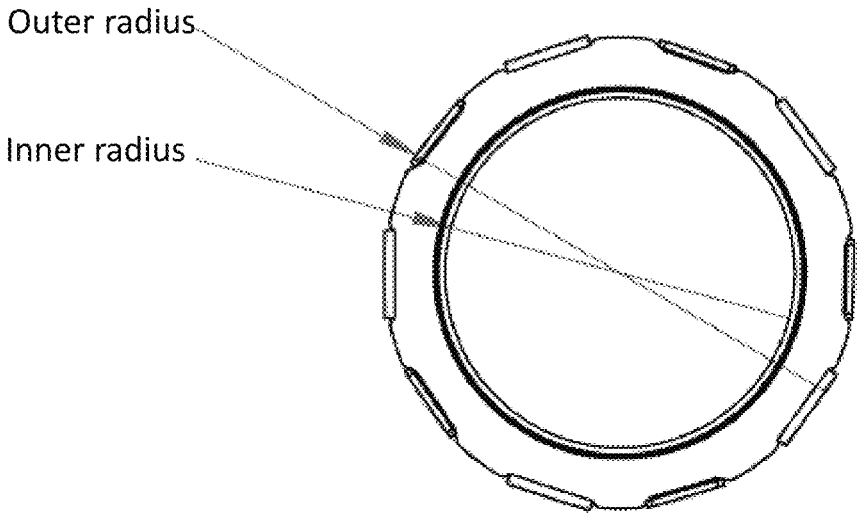
Figure 12:
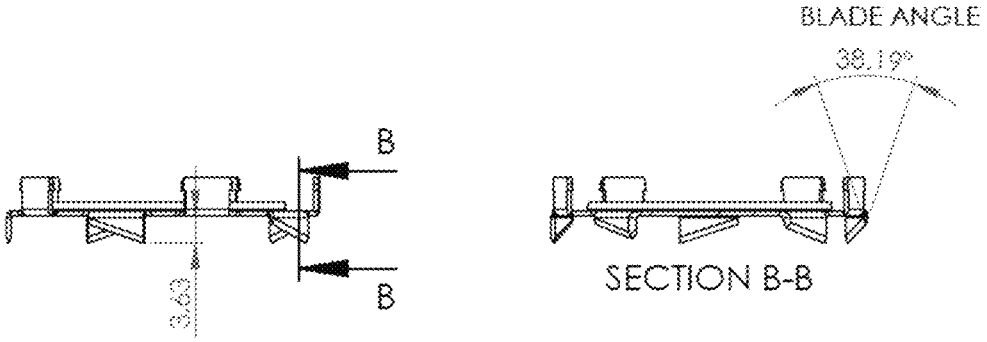

FIG. 10 is an exploded view of the blade cartridge according to another embodiment. The blade cartridge includes a blade outer housing 222 and a blade 226. FIG. 12(A) shows the perspective view of the blade 226, FIG. 12(B) shows the top view of the blade 226, and FIG. 12(C) shows the front and cross-sectional view of the blade 226 with example dimensions. The inner radius of the blade should be large enough to accommodate the protruding part on a surface to be cut. The outer radius should be large enough to cut beyond the flange of the spout inside the carton. In one embodiment, the blade 226 includes one or more cutting edges 224. In one embodiment, the blade 226 includes one or more tabs 228 configured to fit into corresponding slots in the blade outer housing 222. In one embodiment, the blade 226 is made of stamped stainless steel. FIG. 11 shows the top, front and cross-section views of the blade cartridge in the cap according to an embodiment.

Figure 13:
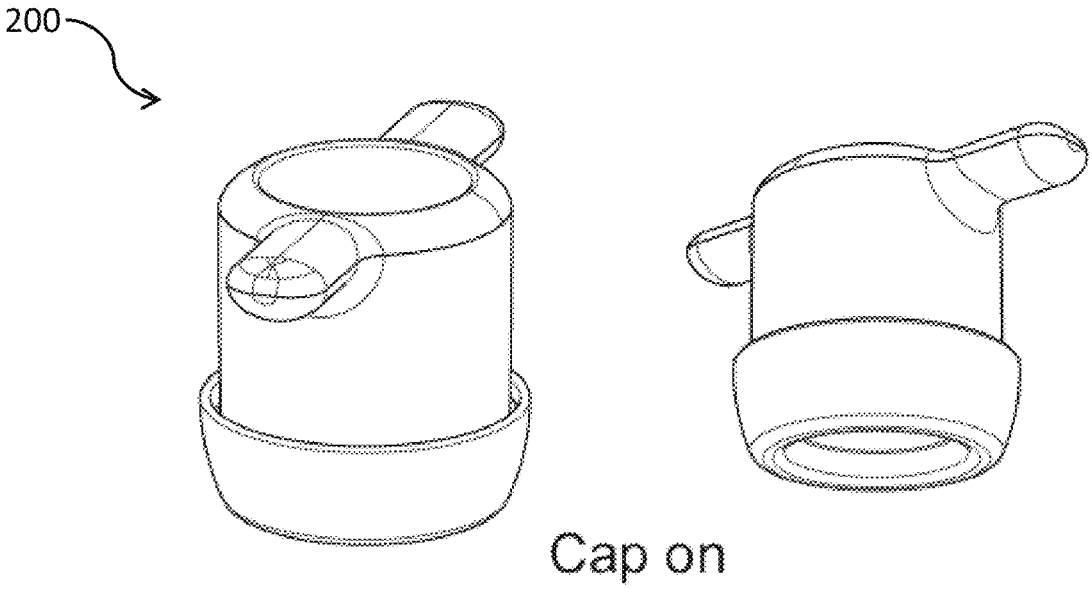
FIG. 13 shows two different perspective views of a cutter device with the cap on according to an embodiment.
Figure 14:
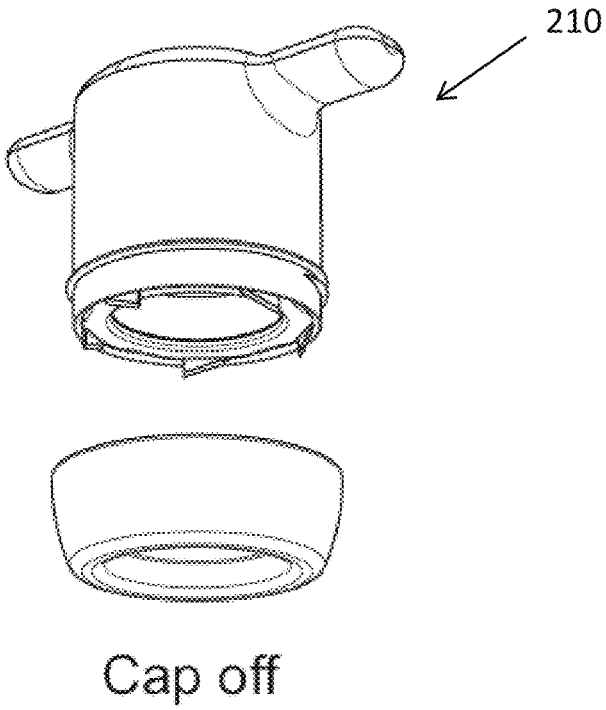
FIG. 14 shows a perspective view of a cutter device with the cap off according to an embodiment.

FIG. 13 shows a cutter 200 according to another embodiment of the present invention. There is an optional cap 130 that covers the blades for safety when the cutter is not in used or in storage. FIG. 14 shows that the blades are exposed when the cap is taken off. In this embodiment, the blade 226 is integrated to the handle.

Figure 15:
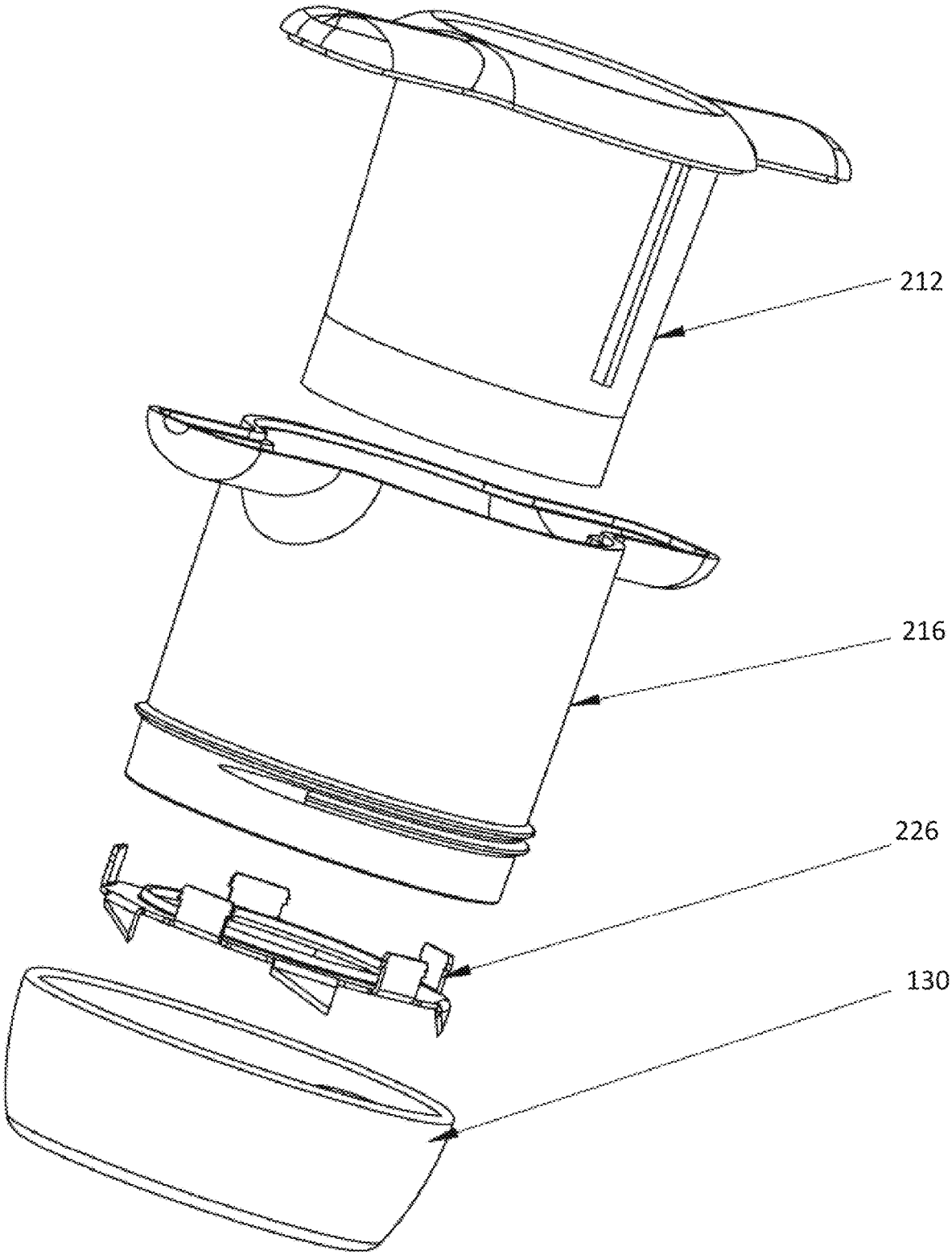
FIG. 15 shows an exploded view of a cutter device according to an embodiment.

FIG. 15 shows an exploded view of a cutter device according to an embodiment. The handle 210 includes a core 212, and a housing 216. The core 212 fits into the housing 216. In one embodiment, the housing 216 is threaded so it can be screwed onto the cap 130. The blade 226 is similar to the one discussed above and shown in FIG. 12. In one embodiment, the blade 226 includes one or more tabs 228 configured to fit into corresponding slots in the housing 216.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A cutting device, comprising:

a handle having a central axis;

a blade cartridge attached to the handle, the blade cartridge comprising a blade housing; and at least one blade arranged in the blade cartridge via the blade housing, a cutting edge of the at least one blade being at a first distance from the central axis;

wherein the handle comprises an opening around the central axis configured to accommodate a protruded part on a surface such that the cutting edge of the at least one blade makes contact with a part of the surface around the protruded part when the protruded part is inside the opening.

2. The cutting device of claim 1, wherein the at least one blade is a plurality of blades, the cutting edge of each of the plurality of blades is at the first distance from the central axis.

3. The cutting device of claim 1, wherein the blade cartridge is integrally attached to the handle.

4. The cutting device of claim 1, wherein the blade cartridge is removablely attached to the handle.

5. The cutting device of claim 1, wherein the handle and the blade cartridge comprise corresponding parts of a snap-fit joint, such that the blade cartridge is attached to the handle by a snap-fit mechanism.

6. The cutting device of claim 1, wherein the blade housing comprises an inner housing part and an outer housing part, the inner part and the outer housing part comprising corresponding parts of a snap-fit joint, such that the inner housing part and outer housing part snap fit to each other along with the blade to define the blade cartridge.

7. The cutting device of claim 1, wherein the handle comprises a core having the opening and a handle housing, and the core is configured to fit into the handle housing to form the handle.

8. The cutting device of claim 7, wherein the core comprises a button-shape projection at one end of the core and the handle housing comprises a hole at a corresponding position of the button-shape projection, the handle housing and the core are matched by the button-shape projection and the hole.

9. The cutting system of claim 8, wherein the core is longer than that of the handle housing in the axial direction, and further comprises a cantilever arm coupled to the button-shape projection, the cantilever arm comprises a hook configured as a snap-fit joint to catch a matching part in the blade cartridge, so as to make the blade cartridge attached or detached from the handle by pressing the button-shape projection.

10. The cutting device of claim 1, wherein the blade cartridge is threaded so as to allow a protective lid having a matching threading to screw onto the blade cartridge for protection of the at least one blade.

11. The cutting device of claim 1, wherein the blade cartridge comprises a part of a snap-fit joint so as to allow a protective lid having a matching part of the snap-fit joint to be pressed onto the blade cartridge by a snap-fit mechanism.

12. The cutting device of claim 1, wherein the blade comprises a plurality of cutting edges, each of the plurality of edges is at the first distance from the central axis.

* * * * *